US006370704B1

(12) United States Patent
White, Jr.

(10) Patent No.: US 6,370,704 B1
(45) Date of Patent: Apr. 16, 2002

(54) FLUID-CELL TOILET SEAT

(76) Inventor: Charles L. White, Jr., 1025 McLaughlin Dr., Charlotte, NC (US) 28212

( * ) Notice: Subject to any disclaimer, the term of this patent is extended or adjusted under 35 U.S.C. 154(b) by 0 days.

(21) Appl. No.: 09/631,607

(22) Filed: Aug. 4, 2000

(51) Int. Cl.[7] ..... A47K 13/00
(52) U.S. Cl. ..... 4/237
(58) Field of Search ..... 4/234–237, 239, 4/240, 245.6, 245.7

(56) References Cited

U.S. PATENT DOCUMENTS

| | | | | |
|---|---|---|---|---|
| 1,163,149 A | | 12/1915 | Hooper | |
| 3,379,800 A | | 4/1968 | Wert | |
| 3,854,150 A | | 12/1974 | Samuels | |
| 3,863,277 A | | 2/1975 | Harrison | |
| 3,949,432 A | * | 4/1976 | Ginsburg | 4/237 |
| 4,085,468 A | * | 4/1978 | Seiderman | 4/237 |
| 4,248,646 A | | 2/1981 | Ginsburg | |
| 4,588,229 A | | 5/1986 | Jay | |
| 4,726,624 A | | 2/1988 | Jay | |
| 4,930,171 A | | 6/1990 | Frantz | |
| 5,991,935 A | | 11/1999 | Wang | |

* cited by examiner

*Primary Examiner*—Robert M. Fetsuga
*Assistant Examiner*—Tuan Nguyen
(74) *Attorney, Agent, or Firm*—John D. Gugliotta

(57) ABSTRACT

A toilet seat is formed of three layers: a base; an insert disposed on the top surface of the base; and, an outer cover layer affixed to the base. The insert forms a plurality of radially disposed water or gel filled cells, each water or gel cell spaced from an adjacent cell by a separator. A fluid cell cover overlays the fluid cells, and is formed of a soft, deformable material. Each cell is filled with and contains a fluid, thereby allowing said toilet seat to provide a contouring support when pressed upon.

6 Claims, 2 Drawing Sheets

FLUID-CELL TOILET SEAT

RELATED APPLICATIONS

There are no previously filed, nor currently any co-pending applications, anywhere in the world.

BACKGROUND OF THE INVENTION

1. Field of the Invention

The present invention relates generally to toilet seat devices and insert structure and, more particularly, to a fluid-cell toilet seat.

2. Description of the Related Art

A search of the prior art did not disclose any patents that read directly on the claims of the instant invention; however, the following references were considered related:

U.S. Pat. No. 5,991,935 issued in the name of Wang for a resilient toilet seat device;

U.S. Pat. No. 3,863,277 issued in the name of Harrison for a soft toilet seat; and U.S. Pat. No. 1,163,149 issued in the name of Hooper.

The following patents describe cushion inserts:

U.S. Pat. No. 4,930,171 issued in the name of Frantz;

U.S. Pat. No. 4,726,624 issued in the name of Jay, and

U.S. Pat. No. 4,588,299 issued in the name of Jay.

The following patents describe method of making cushion structure:

U.S. Pat. No. 4,248,646 issued in the name of Ginsburg and;

U.S. Pat. No. 3,379,800 issued in the name of Wert.

Consequently, the need is still unmet for a toilet seat of a liquid filled, cellular construction for providing both impact cushioning as well as thermal retention.

SUMMARY OF THE INVENTION

It is therefore an object of the present invention to provide for improved comfort in a toilet seat.

It is a feature of the present invention to provide an improved toilet seat by making an insert of water of gel filled fluid cells as opposed to the spongy or foam inserts.

Briefly described according to the preferred embodiment of the present invention, a toilet seat is formed of three layers: a base; an insert disposed on the top surface of the base; and, an outer cover layer affixed to the base. The insert forms a plurality of radially disposed fluid cells, each cell spaced from an adjacent cell by a separator. A fluid cell cover overlays the fluid cells, and is formed of a soft, deformable material. Each fluid cell is filled with and contains a fluid, such as water or gel, thereby allowing said toilet seat to provide a contouring support when pressed upon.

An advantage of the present invention is that as a person sits on the fluid-cell toilet seat, the water cells would form to the contour of the individual's shape for more comfort and flexibility.

Additionally, depending upon the thermal capacity of the fluid used to fill the cells additional heat retention characteristics can be obtained to provide additional comfort.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
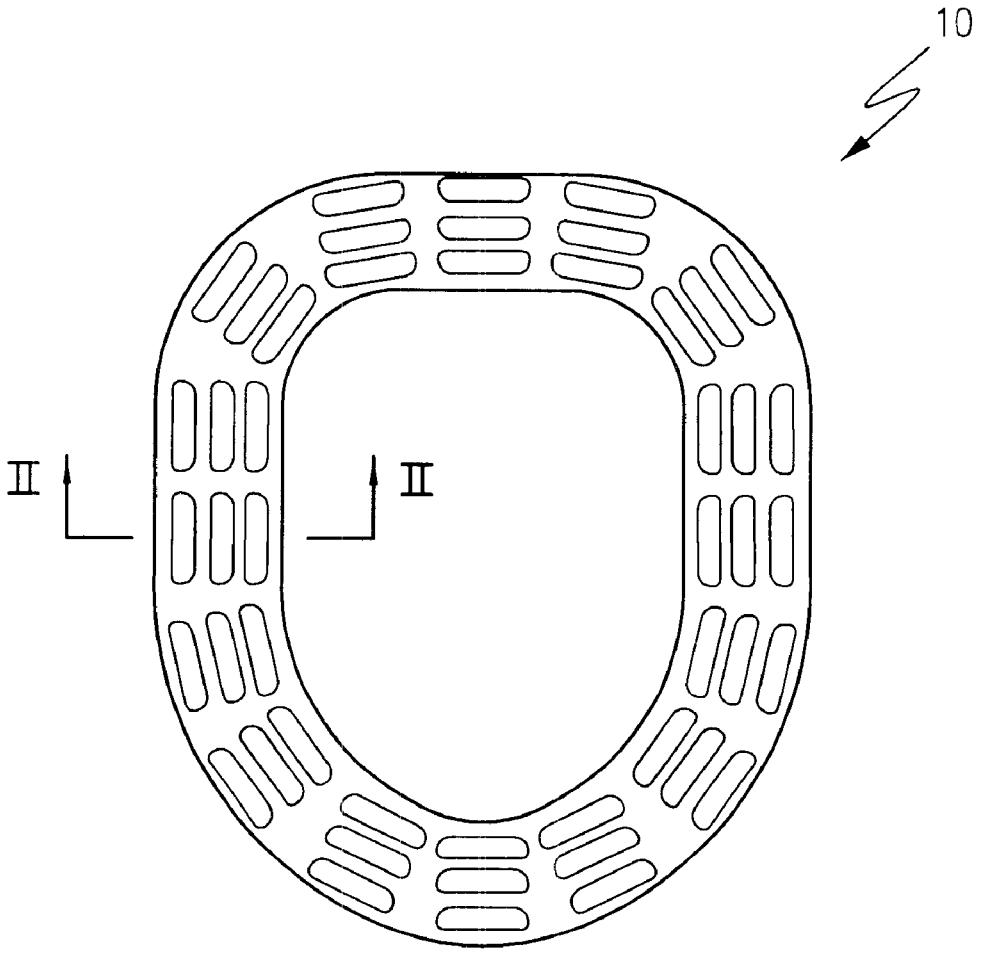
FIG. 1 is a top plan view of a toilet seat having an integrated cellular structure according to the preferred embodiment of the presented invention.
Figure 2:
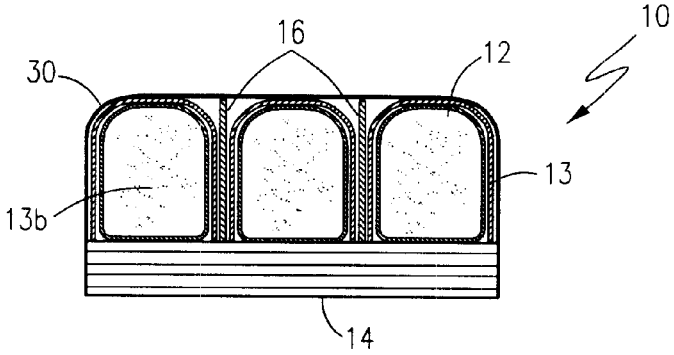
FIG. 2 is a cross sectional view thereof taken along line II—II of FIG. 1.
Figure 3:
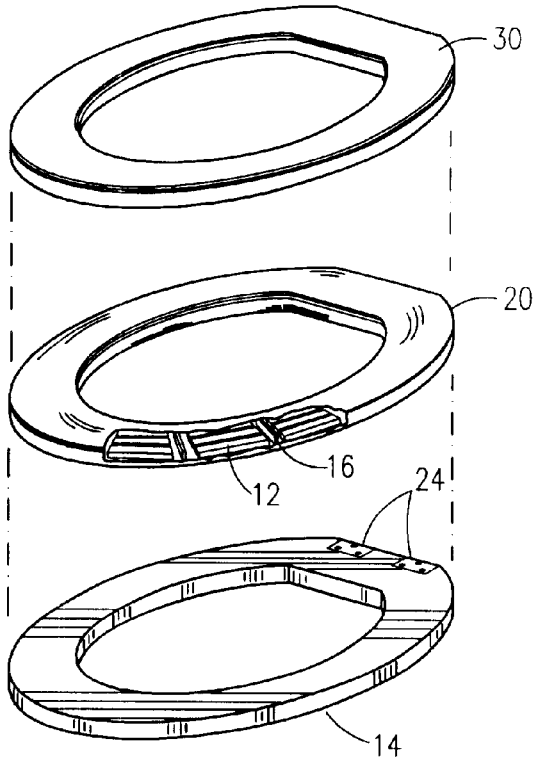
FIG. 3 is an exploded perspective view thereof.

Referring to FIGS. 1–3, a toilet seat 10 is provided for use with a conventional commode in accordance with the present invention including a base 14 made of harder materials such as plastic material. The base 14 includes an annular recess 24 with holes for attachment formed in the posterior and bottom of the base for engaging with an otherwise conventional hinged seat attachment means (not shown) as is generally available commercially. An insert 20 is disposed on the base 14 and includes water cells 12 and separator 16. The water cells 12 include a water cell cover 13 made preferably of soft material such as plastic material. The water cell cover 13 contains fluid 13*b* such as water for more contour and support when used. The water cells 12 are radially positioned and separated by separator 16 made of material such as spongy material or foamable material.

An outer cover layer 30 is affixed to the base 14, thereby impinging the insert 20 therebetween. The outer cover layer 30 is preferably made of flexible material, such as woven cloth, leather product or synthetic leather or rubber or plastic film or the like. The outer cover layer 30 is engaged onto the base 14 by adhesive means, or by a cohesive means such as a hot-pressing process.

2. Operation of the Preferred Embodiment

In operation, the present invention is affixed atop a toilet in an otherwise conventional manner. As a person sits on the water-cell toilet seat 10, the water cells 12 would form to the contour of the individual's shape for more comfort and flexibility. Additionally, depending upon the thermal capacity of the fluid used to fill the cells 12 additional heat retention characteristics can be obtained to provide additional comfort.

The foregoing description is included to illustrate the operation of the preferred embodiment and is not meant to limit the scope of the invention. The scope of the invention is to be limited only by the following claims.

What is claimed is:

1. A toilet seat comprising:

a base having an anterior end opposite a posterior end and a bottom surface opposite a top surface;

an insert disposed on the top surface of said base;

an outer cover layer affixed to said base, thereby impinging said insert therebetween, wherein said insert includes a plurality of water cells radially disposed about said insert, each said water cell spaced from an adjacent water cell by a separator.

2. The toilet seat of claim 1, wherein each said water cell includes a water cell cover formed of a soft, deformable material.

3. The toilet seat of claim 2, wherein said outer cover layer is made of flexible material.

4. The toilet seat of claim 3, wherein said flexible material is selected from the group comprising woven cloth, leather, synthetic leather, rubber, and plastic film.

5. The toilet seat of claim 1, wherein said base is comprised of a hard, rigid material.

6. The toilet seat of claim 5, wherein said base further comprises an annular recess formed in the posterior and bottom of said base for attachment of a hinged seat attachment means.

* * * * *